US006511467B1

(12) United States Patent
Reuss

(10) Patent No.: US 6,511,467 B1
(45) Date of Patent: Jan. 28, 2003

(54) DRAINAGE RESERVOIR GARMENT

(75) Inventor: Denise Reuss, Shoreview, MN (US)

(73) Assignee: La Vest, Inc., Shoreview, MN (US)

( * ) Notice: Subject to any disclaimer, the term of this patent is extended or adjusted under 35 U.S.C. 154(b) by 72 days.

(21) Appl. No.: 09/659,348

(22) Filed: Sep. 12, 2000

(51) Int. Cl.[7] ..... A61F 13/15; A41D 13/04
(52) U.S. Cl. ..... 604/393; 2/48
(58) Field of Search ..... 604/393, 388, 604/398, 399, 402, 322, 410; 2/48–58

(56) References Cited

U.S. PATENT DOCUMENTS 4,087,864 A 5/1978 LaBove et al.
4,231,119 A * 11/1980 Quinn ..... 2/48
4,582,508 A 4/1986 Pavelka
5,716,344 A 2/1998 Kiel
5,755,698 A 5/1998 Kagan et al.

* cited by examiner

*Primary Examiner*—Dennis Ruhl
*Assistant Examiner*—Jamisue A. Webb
(74) *Attorney, Agent, or Firm*—Patterson, Thuente, Skaar & Christensen, P.A.

(57) ABSTRACT

The present invention relates to a medical garment. More specifically, to a drainage reservoir garment for supporting a drainage reservoir assembly including one or more drainage reservoirs. The garment comprises one or more sections of material or fabric, which includes one or more pockets for receiving, supporting and holding one or more drainage reservoirs.

9 Claims, 7 Drawing Sheets

DRAINAGE RESERVOIR GARMENT

FIELD OF THE INVENTION

The present invention relates to a medical garment. More specifically, to a drainage reservoir garment for supporting a drainage reservoir assembly including one or more drainage reservoirs. The garment comprises a section of material or fabric, which includes one or more pockets for receiving, supporting and holding one or more drainage reservoirs.

BACKGROUND OF THE INVENTION

The prior art discloses or suggests a number of garments, harnesses and belts that have been designed to support drainage reservoirs and similar type devices upon a patient's body. The utilization of support assemblies, such as garments, harnesses and belts, provide the patient with a means for positioning a drainage device in an appropriate location and securing it there.

A supporting assembly for a drainage reservoir is especially necessary in a post surgical period. For a period of time after a surgical procedure is performed on a patient, a drainage reservoir is required to be worn by a patient in order to drain away body fluids from the surgical site. In particular, one end of a drainage tube is positioned in the area of the surgical site while the other end is positioned in fluid communication with a drainage reservoir. Thus, excess fluids generated by the body at the surgical site as a result of the trauma of the surgical procedure are removed from the body.

As previously mentioned, various devices and methods have been used to support a drainage reservoir and are designed to be worn by a patient. For example, patients have used bulky garments, harnesses or single strap belts to support a drainage reservoir. Examples of harnesses or belts are disclosed in Kagan et al., U.S. Pat. No. 5,755,698, issued on May 26, 1998, and Kiel, U.S. Pat. No. 5,716,344, issued on Feb. 10, 1998. Each of these inventions provided support assemblies for drainage reservoirs, but was considerably bulky and restrictive to the wearer. Furthermore, the undesirability of these support assemblies becomes compounded when two or more drainage reservoirs are required to be worn by a patient.

An example of a vest assembly is demonstrated in LaBove, U.S. Pat. No. 4,087,864, issued May 9, 1978. The vest disclosed in LaBove is provided for patients undergoing intravenous hyperalimentation treatment. The vest includes pouches to receive bags of hyperalimentation solution, a pocket to receive a pump to transfer the solution to the recipient's body and a pocket for a power supply for the pump. While the vest assembly disclosed by LaBove includes pockets, the pockets are not designed to accommodate drainage reservoirs or tubes attached to drainage reservoirs. The pockets disclosed in the LaBove patent are located on the outside of the vest are not configured to adequately house a drainage reservoir assembly. Furthermore the vest taught in LaBove is not lightweight and is extremely bulky. Therefore the patient may experience added discomfort while wearing the vest, as well as, may find difficulty in wearing the vest under other clothing.

In Pavelka, U.S. Pat. No. 4,582,508, issued on Apr. 15, 1986, a garment for receiving catheters is described. The garment in Pavelka discloses or suggests a garment that includes straps for holding the garment to a patient's body and a pocket element within which to store the catheter. However, Pavelka only discloses the retention of the catheter tube and does not disclose the housing of any apparatus for drainage reserve. Furthermore, the utilization of straps in the device disclosed in Pavelka is susceptible to slippage of the garment over the shoulder or around the body of the patient during the course of wearing it. The movement of the garment away from the intended location is a concern with such strapped support assemblies due to their lack of comfort and also potential to disengage the drainage device.

Furthermore, the use of garments, belts and other support assemblies has been shown in the prior art to have additional disadvantages. One disadvantage is that most of these devices are not designed to allow the device to be quickly and conveniently put on or removed by the patient with little movement or discomfort. Another disadvantage is that some of these devices are made of a material such as leather, vinyl or denim. Devices made of such material are inflexible, bulky, and uncomfortable to a patient during use, and less able to withstand washing or multiple washings in a washing machine. Also, many similar devices fail to accommodate the complete drainage reservoir assembly, which includes tubes and reservoirs.

Therefore, a need exists for an apparatus for supporting a drainage reservoir, which is worn by the patient and is easy and convenient to use. What is further needed is an apparatus for supporting a drainage reservoir which is comfortable to wear and still properly retain the drainage reservoir assembly. Moreover, what is needed is an apparatus for receiving, supporting and holding a drainage reservoir assembly at a location adjacent to a patient's body, which eliminates the risk of injury and pain due to inadvertent movement of the apparatus that dislodges the drainage reservoir. Finally, a support assembly is needed which can accommodate multiple drainage reservoirs at multiple locations on a patient's body.

SUMMARY OF THE INVENTION

The present invention is a garment, which provides a new and improved invention for receiving, holding and supporting a drainage reservoir assembly that is administered to a patient's body. The garment comprises a front panel, an optional back panel, optional tabs and one or more pockets located on the interior of the front panel and/or back panel.

A desired characteristic of a drainage reservoir support assembly is that such an assembly should adequately secure the drainage reservoir and in doing so also restrict movement of the reservoir on the patient's body. A problem which exists with many secure support assemblies is that if they do possess the previously mentioned characteristic, they are generally bulky in appearance and are not comfortable to wear. The drainage reservoir garment of the present invention is intended to support a drainage reservoir in a pocket, therefore restricting the reservoirs movement, as well as provide a comfortable garment for the patient to wear.

An embodiment of the drainage reservoir garment of the present invention comprises a front panel, back panel and a pocket flap. The front panel and back panel are adjoined at two areas on a shoulder line. It is noted that the front panel and back panel may comprise multiple sections of fabric joined together or may comprise a single section of fabric folded at the shoulder line. Between the two areas on the shoulder line is an aperture for the head and neck. The pocket flap is an extension of fabric adjacent to the front panel, which is folded under and secured to the interior of the front panel, thereby producing a pocket. The pocket may be further secured to the front panel at various points, thereby producing a number of smaller pockets capable of adequately receiving, supporting and holding more than one drainage reservoir. The garment may also include tabs that are adjoined to either side of the front and back panels. The tabs may include fasteners to secure to each other or may be used as tie strings for securing the front and back panels to each other at the side of the patient's body. Generally, the garment may be worn by pulling it over the head of the patient, inserting the drainage reservoirs into the pockets and securing the front and back panels together with the tabs. If no back panel exists, the garment can be secured to a patients body by use of tabs around the neck and back of the patient, similar to a bib for a small child.

Therefore, it is one object of the present invention to provide a new and useful assembly for supporting a drainage reservoir assembly, which provides a more secure attachment to the wearer's body. The additional stability will protect the wearer from injury or discomfort by further restricting the movement of the drainage reservoir.

It is another object of the present invention to provide an improved garment for supporting a drainage reservoir which is lightweight and not bulky. Also, it is an object of the present invention to provide a garment for supporting a drainage reservoir at a location adjacent to a patient's body which is more comfortable to a user and may be worn with other clothing.

It is a further object of the present invention to provide a new and useful drainage reservoir garment which can support multiple drainage reservoirs or support a drainage reservoir in multiple positions on a patient's front and back torso.

It is yet another object of the present invention to provide a garment for supporting a drainage reservoir assembly, which is easier to put on and remove without causing discomfort to the patient and/or dislodging the drainage reservoir assembly.

It is moreover an object of the present invention to provide a garment for supporting a drainage reservoir assembly, which allows a patient to be more independent, which includes added mobility and less assistance from others.

It is yet another object of the present invention to provide a garment for supporting a drainage reservoir assembly, which may be worn easily with a patient's clothing.

It is a further object of the present invention to provide a garment for supporting a drainage reservoir assembly, which can be quickly and conveniently put on and removed from a patient's body with little movement and less discomfort.

Another object is to allow easy access to the drainage site by the patient, medical professionals or others that assist in the care of the drainage site.

The above and other objects, features, and advantages of the present invention will become apparent from the following description and the attached drawings.

DETAILED DESCRIPTION OF THE INVENTION

Figure 1:
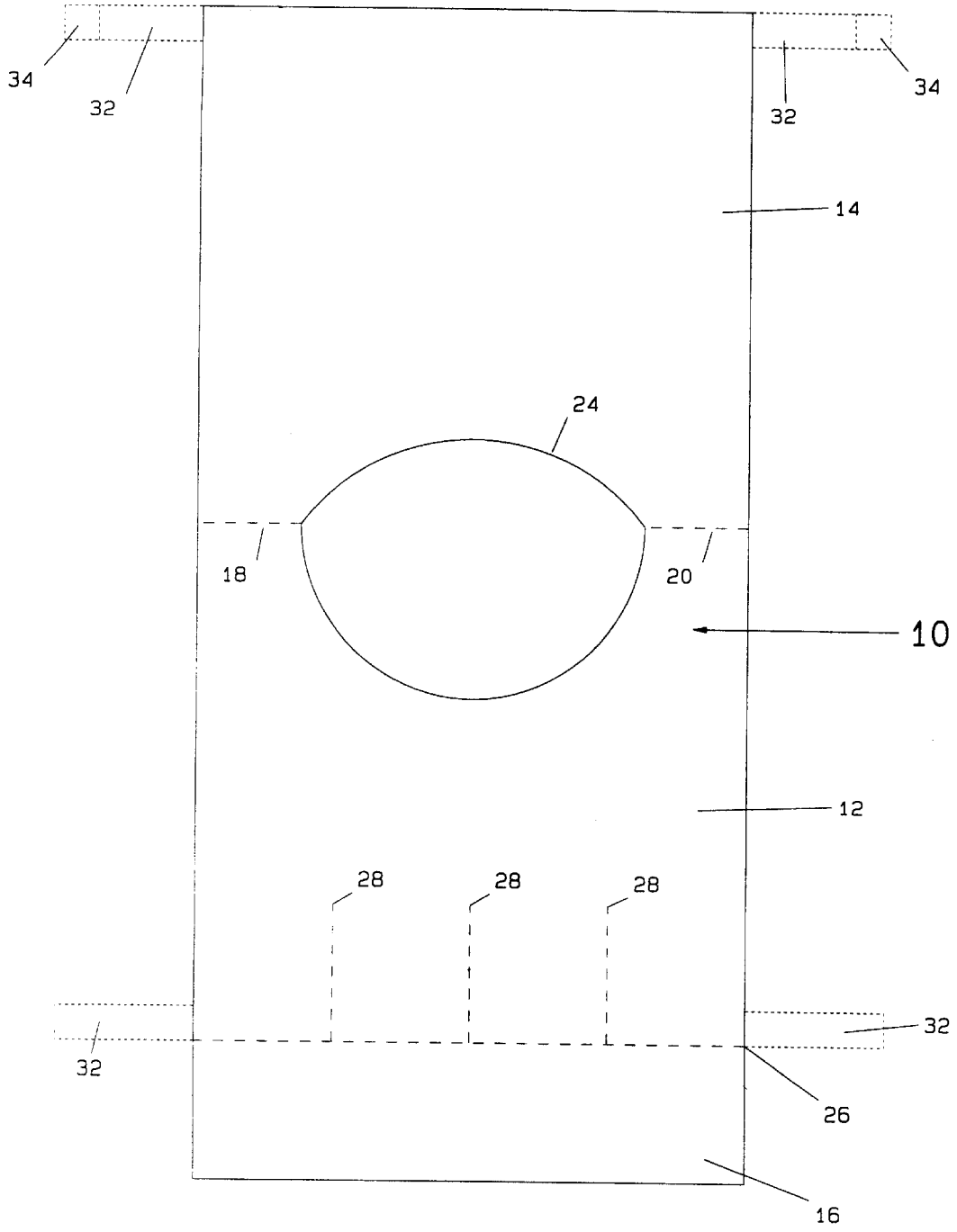
FIG. 1 depicts a plan view of a drainage reservoir garment which includes a rounded head/neck aperture.

While the invention is susceptible to various modifications and alternative forms, specific embodiments thereof have been shown by way of example in the drawings and will herein be described in detail. It should be understood, however, that there is no intent to limit the invention to the particular form disclosed, but on the contrary, the intention is to cover all modifications, equivalents, and alternatives falling within the spirit and scope of the invention as defined by the appended claims.

Figure 2:
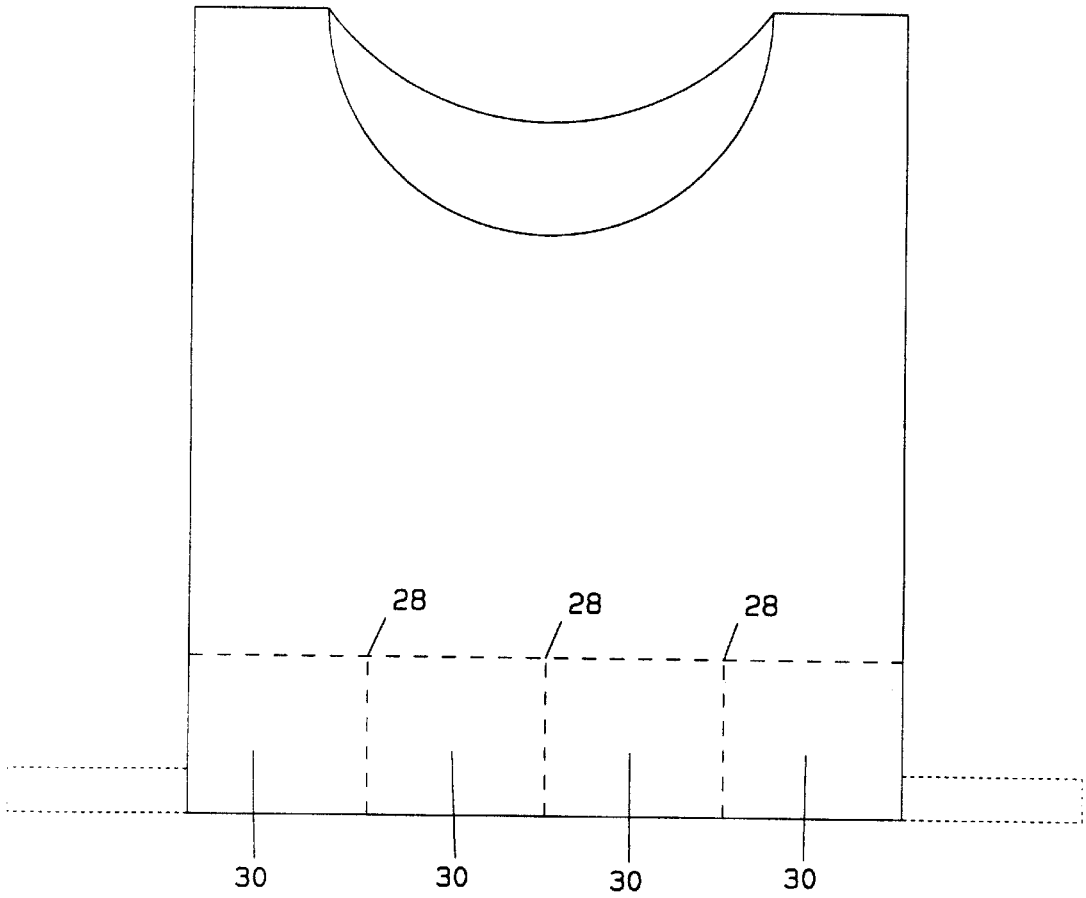
FIG. 2 depicts a front view of a drainage reservoir garment which includes a rounded head/neck aperture.
Figure 3:
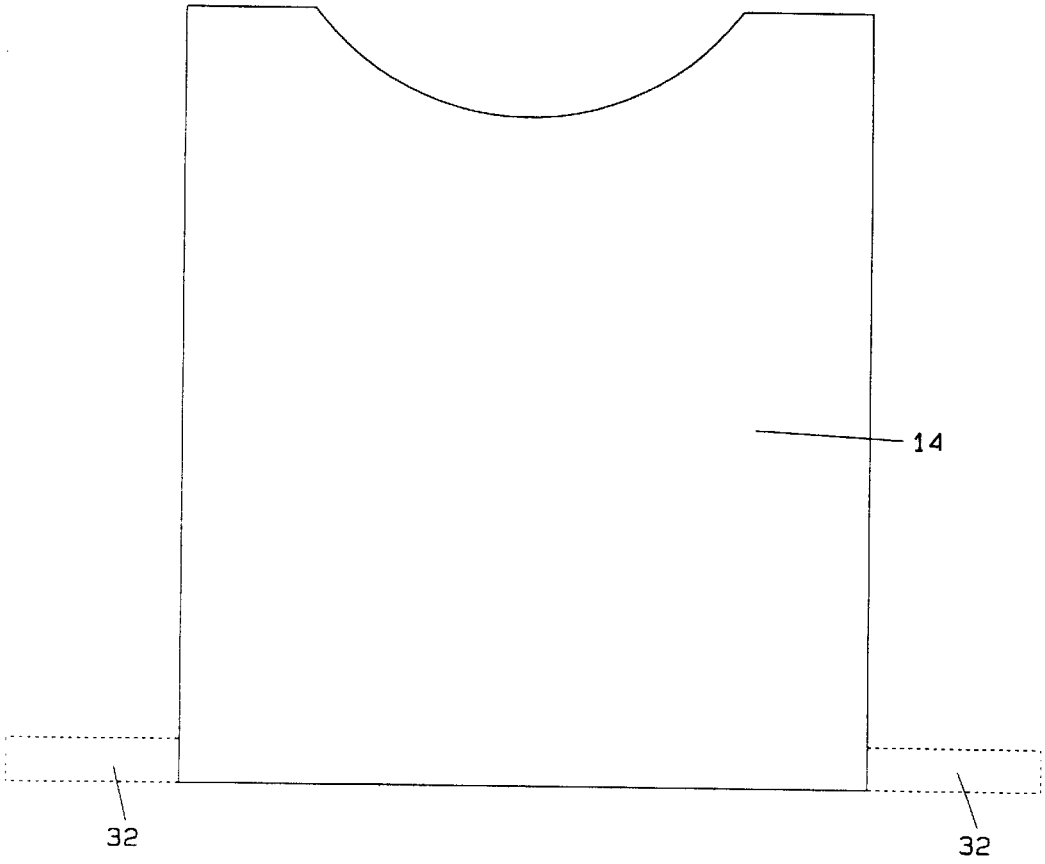
FIG. 3 depicts a back view of a drainage reservoir garment which includes a rounded head/neck aperture.
Figure 4:
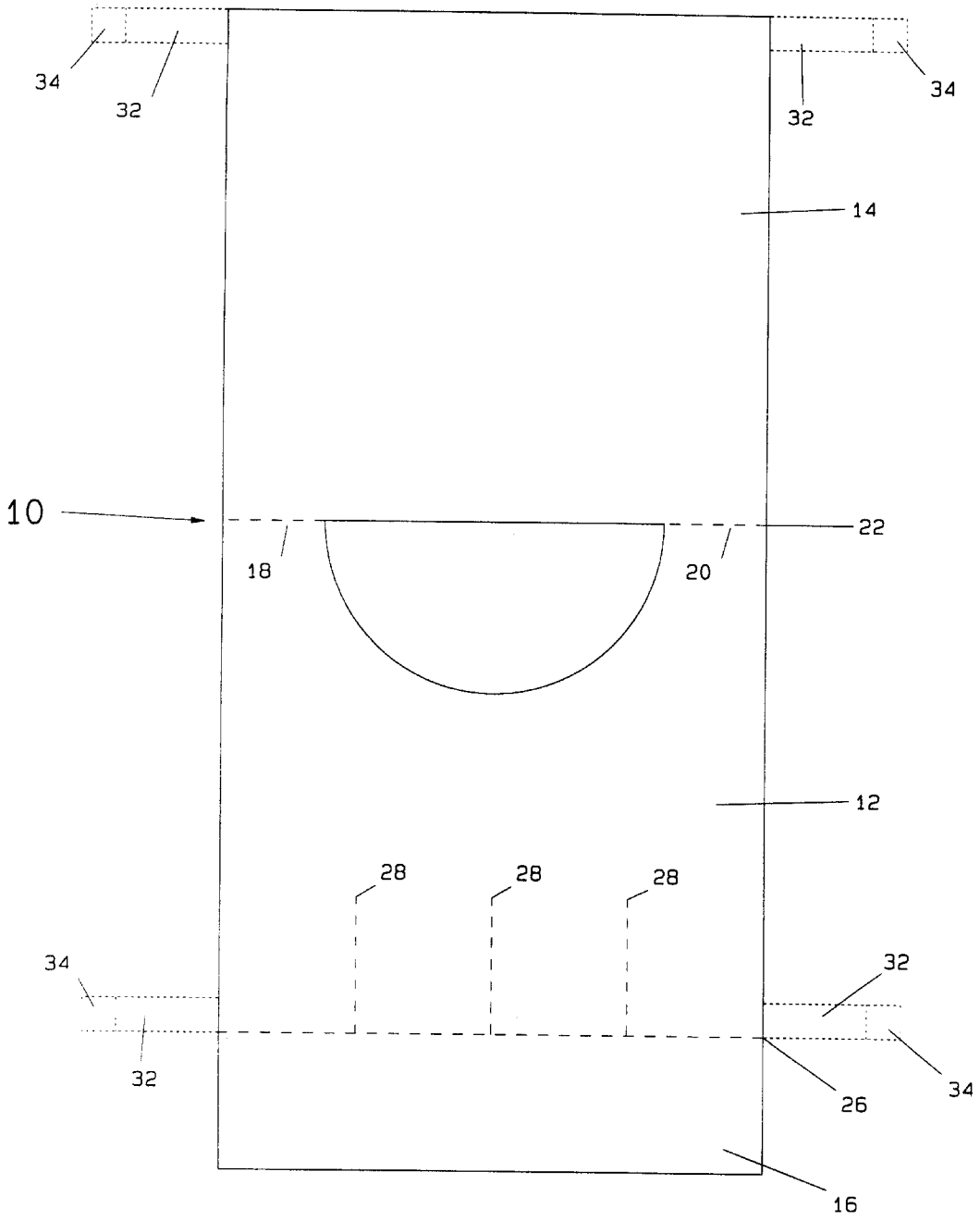
FIG. 4 depicts a plan view of a drainage reservoir garment which includes a squared head/neck aperture.

Referring now to FIGS. 1–6, there is depicted plan, front and back views of two embodiments of a drainage reservoir garment 10. FIGS. 1 and 4 depict plan views of two embodiments of the garment 10, which includes a front panel 12, a back panel 14 and a pocket flap 16. It should be noted that multiple pocket flaps 16 may be utilized in the drainage reservoir garment 10 and may be adjacent to either the front panel 12 or back panel 14. The garment 10 is designed to support one or more drainage reservoirs by insertion of the reservoirs into a pocket or pockets created by the pocket flaps 16. The pocket flap or flaps 16 are secured to the interior of the front panel 12 or back panel 14.

Figure 5:
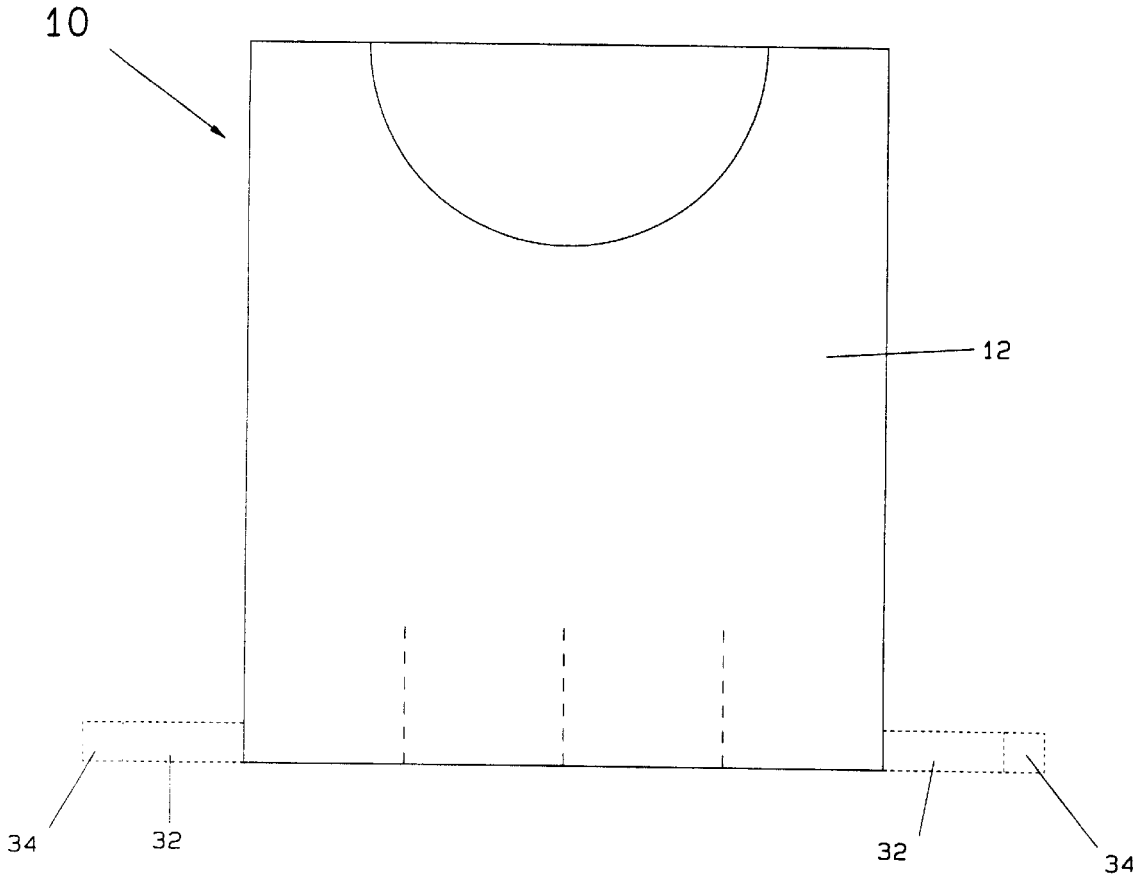
FIG. 5 depicts a front view of a drainage reservoir garment which includes a squared head/neck aperture.
Figure 6:
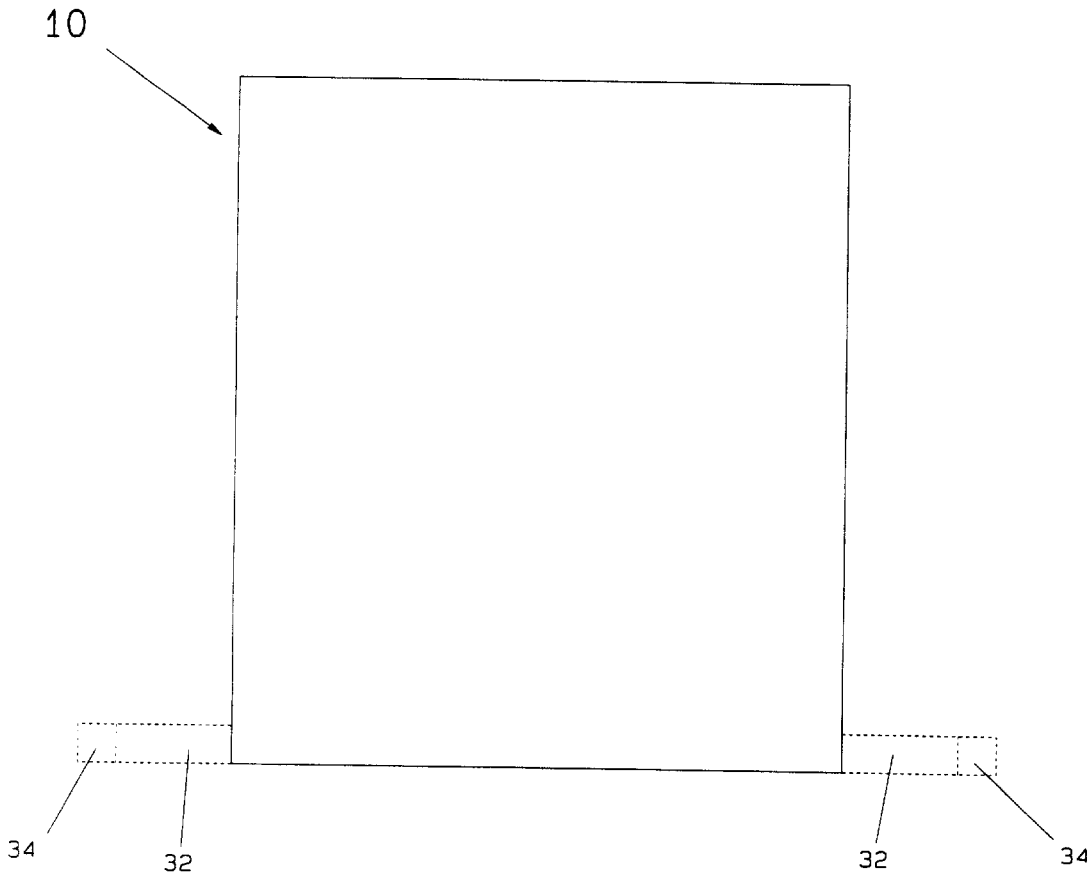
FIG. 6 depicts a back view of a drainage reservoir garment which includes a squared head/neck aperture.

The front panel 12 and back panel 14 are adjoined at two locations 18 and 20 on a shoulder line 22. It is noted that the front panel 12 and back panel 14 may comprise multiple sections of fabric joined together by any means, such as adhesive, stitching, Velcro® or any other suitable attachment means, or may comprise a single section of fabric folded at the shoulder line. Between the two areas on the shoulder line is an aperture 24 for the head and neck. FIGS. 1–3 depict the aperture 24 in a rounded configuration and FIGS. 4–6 depict the aperture 24 in a squared configuration. However, the head/neck aperture 24 may be configured in any shape, which is conducive to an individual placing the garment 10 over one's head and neck. The aperture 24 may be round, oval, square, v-neck or any other shape that may allow a patient's head to easily maneuver through.

The pocket flap 16 is an extension of material or fabric adjacent to the front panel 12, which may be folded under on a hinge line 26 and secured to the interior of the front panel 12. One embodiment of the invention, depicted in FIGS. 2 and 5, illustrates the pocket flap 16 secured along a portion of the front panel's side edges. The side edges of the front panel 12 act as a first set of pocket lines 28. The pocket flap 16 may be further secured to the front panel at additional pocket lines 28, thereby producing a number of smaller pockets 30 capable of adequately receiving, supporting and holding more than one drainage reservoir. A drainage reservoir which may be used with the present invention is a J-VAC Bulb Suction Reservoir available from Johnson & Johnson Medical of Arlington, Tex. 76004-3130. Furthermore, the tubes, which may be used in such a drainage reservoir system, are Jackson Pratt drain tubes. However, the present invention is not limited to this particular type of drainage reservoir and can be utilized with many other types of drainage reservoirs simply by adjusting the size and shape of the pockets.

Additionally, it is noted that pocket flaps 16 and the resulting pockets 30 are not limited in location to the bottom of the front panel 12. Pocket flaps 16 and the resulting pockets 30 may be located at any position on the front panel 12 and/or back panel 14 that may be most beneficial to achieving the previously mentioned objectives. Therefore, a hinge line 26 may occur in a location where a pocket flap 16 is initially secured to the front panel 12 or back panel 14 by a means other than folding. The pocket flap 16 may be secured to the front or back panel by sewing, stapling pressing, gluing, snapping, buttoning, hooking, tying and/or by any other means so as to adjoin the pocket flap to the garment.

Another embodiment, not shown, may include the pocket flap 16 folded upon the hinge line 26 outward and secured to the exterior of the front panel 12 or back panel 14. This embodiment would require another aperture in the panel adjoined to the pocket flap 16 to accommodate the catheter's attachment to a drainage reservoir; since the drainage reservoir is supported in an outside pocket. This embodiment may have advantages in retaining the catheter or tubing in a finite location and also allow for easy access to the drainage reservoirs. However, even where the pockets are located on the interior of each panel, additional pockets or retention straps may be included to retain the catheter or tube in a restricted position.

The garment may also include tabs 32 that are adjoined to the front panel 12 and back panel 14. The tabs 32 may include fasteners 34 located on the ends of each tab 32 to secure a tab 32 located on the front panel 12 to a corresponding tab 32 located on the back panel 14. The fasteners 34 for the present assemblies, preferably, comprise a loop material attached to a tab 32 adjoined to either the front panel 12 or back panel 14 and a hook material attached to a tab 32 on the opposite corresponding panel. A common loop and hook material used for such releasable attachment is Velcro®. Other suitable fasteners include hook and pile fasteners, snaps, buttons, strings and medical grade adhesives to just mention a few. In the alternative, the tabs 32 may be used as tie strings for securing the front panel 12 and back panel 14 to each other at the side of the patient's body. It is noted that in all embodiments of the present invention, the tabs 32, which include fasteners 34, may include adjustment devices for sizing, such as buckles. Additional or extended fasteners for attachment at various locations on the tabs 32 may also be utilized for adjustment purposes.

FIGS. 3 and 6 depict the back panel 14 of the drainage reservoir garment 10. It should be noted that the back panel 14 may vary in length from a thin strip of material covering the back of the neck to a length of material covering the entire back and ending just below the waist. As previously described, the back panel 14 may include tabs 32 for securing the garment 10 to the patient. The tabs 32 may include fasteners 34, as previously explained, or may be of the length to facilitate tying.

Figure 7:
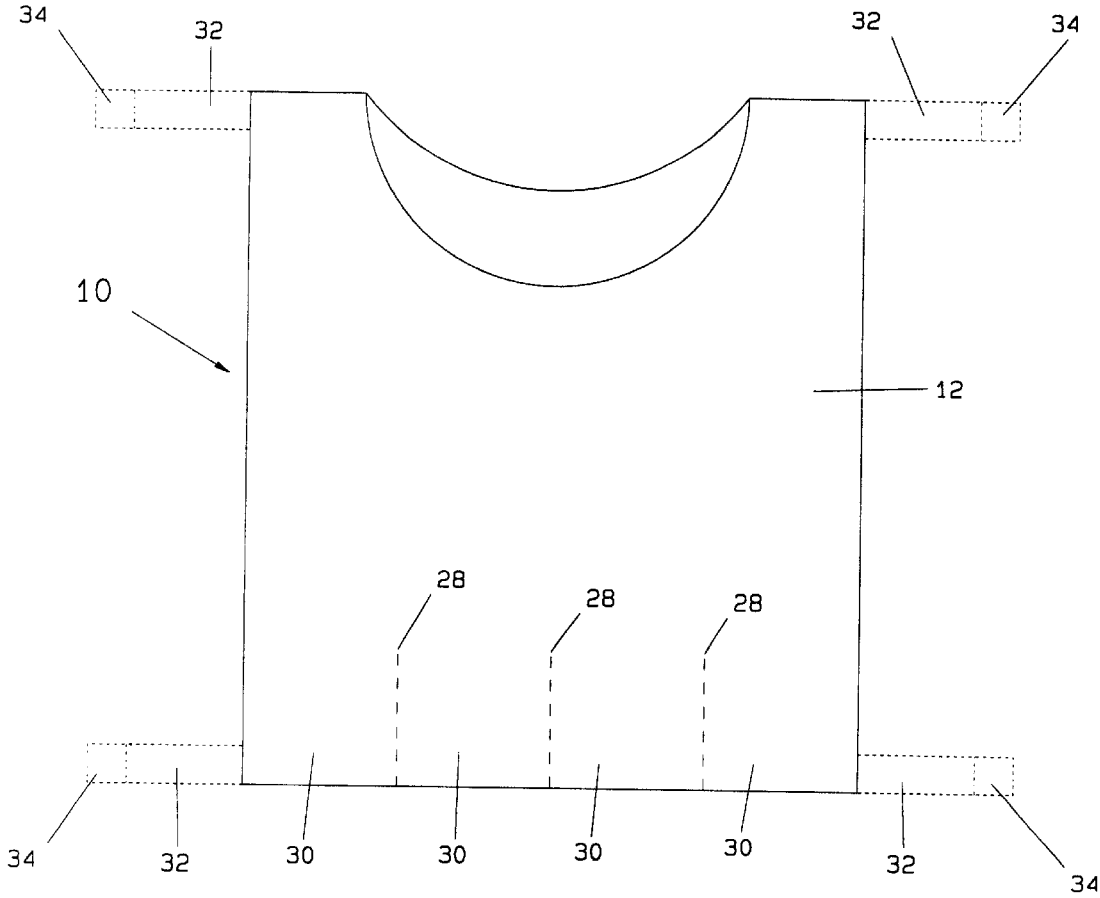
FIG. 7 depicts a front view of a drainage reservoir garment which does not include a back panel.

FIG. 7 depicts another embodiment of the drainage reservoir garment 10 wherein no back panel is included. The garment 10 comprises a front panel 12, which is similar to the front panel 12 previously described in the previous embodiments. However, this embodiment is held to the patient by extended tabs 32. The tabs 32 can be tied or fastened to each other after being wrapped around the patient's neck and/or back.

Another embodiment, not shown, may include single tabs 32, which wrap entirely around the neck and back of a patient and are subsequently secured to the front panel by fasteners 34. Preferred fasteners 34 for such an embodiment would be Velcro®, hook and pile fasteners, buttons, snaps or other similar fastening devices.

The drainage reservoir garment may vary in size and can be utilized for patients of variable size based upon the elasticity of the front and back panels and the elasticity of the tabs. However, one embodiment of the invention may include the following dimensions: front panel 12 and back panel 14, 18" in length and 16" wide; pocket flap 16, 4" in length and 16" wide; pocket lines 28, 4" in length and separated by 4"; head/neck aperture 24, 10" wide and 5" in length from shoulder line 22 and tabs 32, 4" long and 1"wide.

In operation, the garment 10 may be worn by pulling it over the head of the patient as a t-shirt or dickey would be pulled over the head of an individual. Next, one or more drainage reservoirs are placed within a pocket or pockets 30. Finally, the tabs 32 located on the front panel 12 are secured or fastened to the corresponding tabs 32 located on the back panel 14 and adequately adjusted to the proper fit.

Regarding an embodiment, which does not include a back panel, one set of tabs 32 are secured or fastened. Next, one or more drainage reservoirs are placed within a pocket or pockets 30. Finally, the remaining tabs 32 located on the front panel 12 are secured or fastened and all sets of tabs 32 are adequately adjusted to the proper fit.

It is obvious, from the foregoing teachings, that the invention can be easily and economically manufactured of various materials so as to provide a safe and convenient method of storing and receiving drainage reservoirs. Furthermore, the drainage reservoir garment described above can be mass produced or custom manufactured without difficulty from a variety of readily available and inexpensive materials, including, but not limited to, cloth, plastics of various types, leather, rubber or the like, vinyls, and/or paper-type products, including paper products which would be more or less disposable in nature.

Typically, a woven fabric is used, which is adapted for repeated washing and drying in household appliances making for effortless clean-up. A reasonably comfortable, elastic or elasticized primarily cotton material, or equally desirable alternative, of the desired solid color or with a desired pattern of color(s) and or design(s) is preferred which is naturally non-irritating to the skin of most adults, children and infants. The best mode of this invention employs an elastic or elasticized, primarily cotton material to ensure a snug fit although such is not required in light of the many inexpensive and desirable alternatives.

The primarily cotton or other equally desirable alternative material may be pre-treated with suitable chemicals and or treatments, which are known to prevent or resist staining, absorption or degradation upon exposure to blood, medical or other bodily fluids and substances. Other reusable and disposable materials are readily available (e.g. those presently used for hospital gowns, surgical smocks and masks) which are well suited for construction of this invention. In fact, health care facilities concerned with infection control and minimization of waste materials may in some short-term care or high-infection-risk situations prefer more inexpensive, disposable materials which are easily disinfected, incinerated or otherwise disposed of within the capabilities of existing nosocomial systems.

While an elastic or elasticized, absorbent, soft and breathable primarily cotton material is often preferred for those portions of the drainage reservoir garment in contact with the patient's skin, the garment, may be constructed entirely or in combination with a plastic, plasticized or other material treated by methods known to the art which result in the garment being incapable of or resistant to staining, absorption, or deterioration caused by exposure to blood, medical or other bodily substances and designed for quick and easy cleaning such that the entire drainage reservoir garment need not be cleaned every time medical fluids or blood contact the garment material.

Furthermore, the tabs employed to allow for an adjustable configuration and securing of the garment would permit a comfortable snug fit with or without the use of an elastic material. Therefore, the tabs may be manufactured with the same material utilized in the rest of the garment or may comprise a material more suitable for securing the garment to the patient. A stretchable, elastic material may be utilized for the tabs so that a secure snug fit can be accomplished. However, a non-stretchable material may also be utilized which optionally includes a means for adjustment. Such a non-stretchable material with adjustment means may have the advantages of allowing for a snug fit when appropriate and also allowing for a loose fit when appropriate.

While the invention has been illustrated and described in detail in the drawings and foregoing description, such an illustration and description is to be considered as exemplary and not restrictive in character, it being understood that only the preferred embodiments have been shown and described and that all changes and modifications that come within the spirit of the invention are desired to be protected.

What is claimed is:

1. A drainage reservoir garment comprising:

a front panel having an interior surface and an exterior surface;

a back panel having an interior surface and an exterior surface, wherein the back panel is adjoined at a shoulder line to the front panel;

a head/neck aperture positioned on or adjacent to the shoulder line; and a plurality of pockets attached to the interior surface of at least one of the front panel and the back panel.

2. The drainage reservoir garment of claim 1, wherein the interior surface of the front panel is adjacent the interior surface of the back panel and so that the exterior surface of the front panel is adjacent to the exterior surface of the back panel.

3. The drainage reservoir garment of claim 1, wherein the plurality of pockets are secured to at least one of the front panel and the back panel by stitching or an adhesive.

4. The drainage reservoir garment of claim 1, wherein the garment is made of a woven fabric.

5. The drainage reservoir garment of claim 4, wherein the woven fabric is treated to prevent or resist staining, absorption or degradation.

6. The drainage reservoir garment of claim 1, and further comprising at least one tab adjoined to at least one of the front and back panels for securing the front panel to the back panel.

7. The drainage reservoir garment of claim 6, wherein each of the at least one tab includes a fastener.

8. The drainage reservoir garment of claim 7, wherein the fastener is a hook and loop fastener or a hook and pile device.

9. A method of collecting fluid that is discharged from a human body having a torso and a head extending from the torso, the method comprising:

providing a drainage reservoir garment that includes a front panel and a back panel, wherein the drainage reservoir garment has a head/neck aperture extends through the front panel and the back panel proximate an intersection of the front and back panels;

attaching a reservoir pocket to an interior surface of at least one of the front panel and the back panel;

extending the head through the head/neck aperture;

securing the drainage reservoir garment to the torso by removably attaching the front panel to the back panel so that the front panel and the back panel extend substantially around the torso;

attaching a drainage reservoir to a tube that extends from the human body; and placing the drainage reservoir into the reservoir pocket, wherein the drainage reservoir garment maintains the drainage reservoir in a substantially constant position with respect to the torso.

* * * * *